US008172581B2

(12) United States Patent
Yeh

(10) Patent No.: US 8,172,581 B2
(45) Date of Patent: May 8, 2012

(54) ELECTRICAL CONNECTOR CONFIGURED BY UPPER AND LOWER HOUSINGS WITH CONTACT TERMINALS DISPOSED THEREBETWEEN

(75) Inventor: Cheng-Chi Yeh, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 32 days.

(21) Appl. No.: 12/892,940

(22) Filed: Sep. 29, 2010

(65) Prior Publication Data

US 2011/0076862 A1 Mar. 31, 2011

(30) Foreign Application Priority Data

Sep. 30, 2009 (TW) ..... 98218016 U

(51) Int. Cl.
*H01R 12/00* (2006.01)

(52) U.S. Cl. ..... 439/70; 439/856

(58) Field of Classification Search ..... 439/66, 439/67, 70, 71, 81–83, 851, 856, 857
See application file for complete search history.

(56) References Cited

U.S. PATENT DOCUMENTS

| | | | | |
|---|---|---|---|---|
| 5,730,606 | A | 3/1998 | Sinclair | |
| 7,074,048 | B2 | 7/2006 | Liao et al. | |
| 8,033,877 | B2 * | 10/2011 | Di Stefano | 439/851 |
| 2001/0024892 | A1 * | 9/2001 | Ochiai | 439/67 |

* cited by examiner

*Primary Examiner* — Khiem Nguyen
(74) *Attorney, Agent, or Firm* — Andrew C. Cheng; Wei Te Chung; Ming Chieh Chang

(57) ABSTRACT

An electrical connector for electrically connecting a circuit processing unit (CPU) with a number of soldering balls to a print circuit board (PCB) comprises a first body having a plurality of bottom holes, a second body mounted on the first body and having a plurality of upper holes, a plurality of terminals located between the first body and the second body, and a number of fusible members holed by the terminals. Each terminal includes a planar horizontal base portion, a plurality of upper hands and lower legs respectively bent upwardly and downwardly from the base portion, and a plurality of holding portions extending from the base portion in a horizontal direction. The upper hands received in the upper holes can hold the soldering balls. The lower legs received in the bottom holes can hold the fusible members and be soldered to the PCB through the fusible members.

10 Claims, 9 Drawing Sheets

ELECTRICAL CONNECTOR CONFIGURED BY UPPER AND LOWER HOUSINGS WITH CONTACT TERMINALS DISPOSED THEREBETWEEN

BACKGROUND OF THE INVENTION

1. Field of the Invention

The present invention relates to an electrical connector, and more particularly to an electrical connector configured by upper and lower housings with contact terminals disposed therebetween. The contact terminals each includes a pair of legs secured in the lower housing, and a pair of hands extending into the upper housing.

2. Description of Related Art

Electrical connectors used to interconnect a central processing unit (CPU) to a printed circuit board (PCB) can be categorized into an Land Grid Array (LGA), a Ball Grid Array (BGA), and a Pin Grid Array (PGA).

An LGA-BGA connector disclosed in U.S. Pat. No. 7,074,048 which issued to Liao et al. on Jul. 11, 2006 includes an insulating housing having a plurality of passageways extending therethrough and a plurality of conductive terminals respectively received in the passageways of the insulating housing. Each terminal has a base portion, an elastic arm and a solder portion extending from opposite sides of the base portion, and a contacting portion located at a free end of the elastic arm. The solder portion has a solder ball attached thereon. The LGA-BGA connector establishes electrical connecting between the CPU and the PCB by reflowing the solder portions of the terminals to conductive pads of the PCB and the contacting between the contacting portions of the terminals and conductive pads of the CPU.

However, the height of the connector is increased by the structure of the terminals, so that the connector can not meet the development tread of low height.

U.S. Pat. No. 5,730,606 which issued to William on Mar. 24, 1998 discloses an electrical connector. The electrical connector includes an insulating housing having a plurality of passageways extending therethrough and a plurality of terminals received in corresponding passageways. Each terminal comprises a planar horizontal base portion having an upper surface and a lower surface opposite to each other, a pair of opposing arms and a pair of resilient opposing tangs extending upwardly from the upper surface of the base portion. The terminal has a fusible member attached to the lower surface thereof. The electrical connector establishes electrical connection between the CPU and the PCB through the arms of the terminals clamping solder balls of the CPU and soldering the terminals to the PCB by fusible members. However, the electrical connector need to predeterminately solder fusible members to the lower surfaces of the base portions, so as to increase costs and make process complex.

Another existing electrical connecting device comprises a printed circuit board (PCB) having a plurality of fusible members attached thereon and a central processing unit (CPU) with a plurality of solder balls. The electrical connecting device establishes electrical connection between the CPU and the PCB through the solder balls of the CPU being directly welded with the fusible members of the PCB. The electrical connecting device does not have an electrical connector located between the CPU and the PCB, so as to reduce the height of the electrical connecting device and make cost down. However, the CPU can be hardly removed in case of rework after the CPU is directly welded to the PCB.

In view of the above, an improved electrical connector for electrically connecting the CPU with the PCB is needed.

SUMMARY OF THE INVENTION

Accordingly, an object of the present invention is to provide an electrical connector for low profile application and effectively avoiding reducing faulty soldering during welding the CPU to the PCB.

In order to achieve the above object, an electrical connector in accordance with a preferred embodiment of the present invention comprises an insulating housing having a plurality of passageways extending therethrough and a plurality of terminals respectively received in the corresponding passageways. Each terminal includes a base portion having an upper surface and a lower surface opposite to the upper surface, a plurality of holding portions extending from the base portion, and a plurality of upper hands bent upwardly from the base portion and a plurality of lower legs bent downwardly from the base portion.

Other objects, advantages and novel features of the invention will become more apparent from the following detailed description when taken in conjunction with the accompanying drawings, in which:

DETAILED DESCRIPTION OF THE INVENTION

Figure 1:
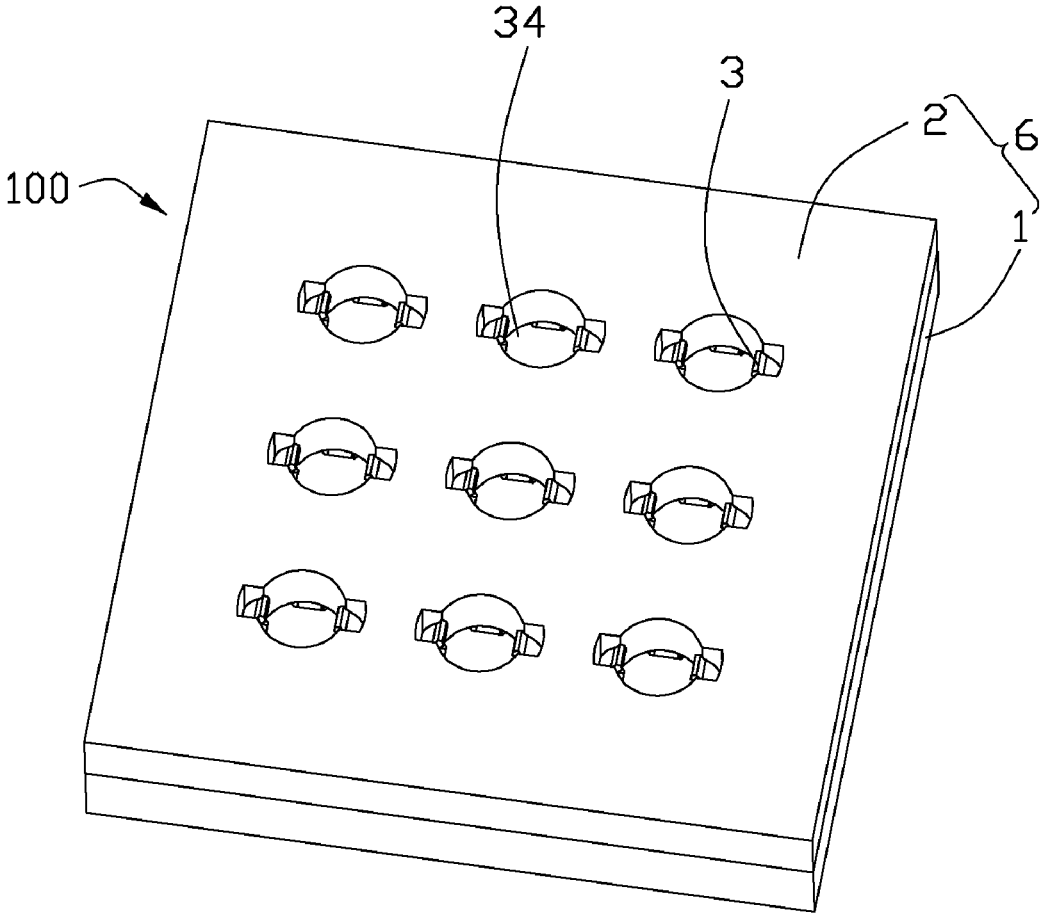
FIG. 1 is an assembled, perspective view of an electrical connector in accordance with a preferred embodiment of the present invention.

Reference will now be made to the drawings to describe the present invention in detail.

FIGS. 1-9 illustrate an electrical connector 100 in accordance to a preferred embodiment of the present invention, which is generally used for connecting a CPU 5 with a plurality of solder balls 50 to a PCB (not shown). The electrical connector 100 comprises an insulating housing 6 having a plurality of passageways 60 extending therethrough and a plurality of terminals 3 respectively received in the passageways 60. The insulating housing 6 includes a first body 1 and a second body 2 assembled on the first body 1. Each terminal 3 has a fusible member 4 attached thereto.

Figure 2:
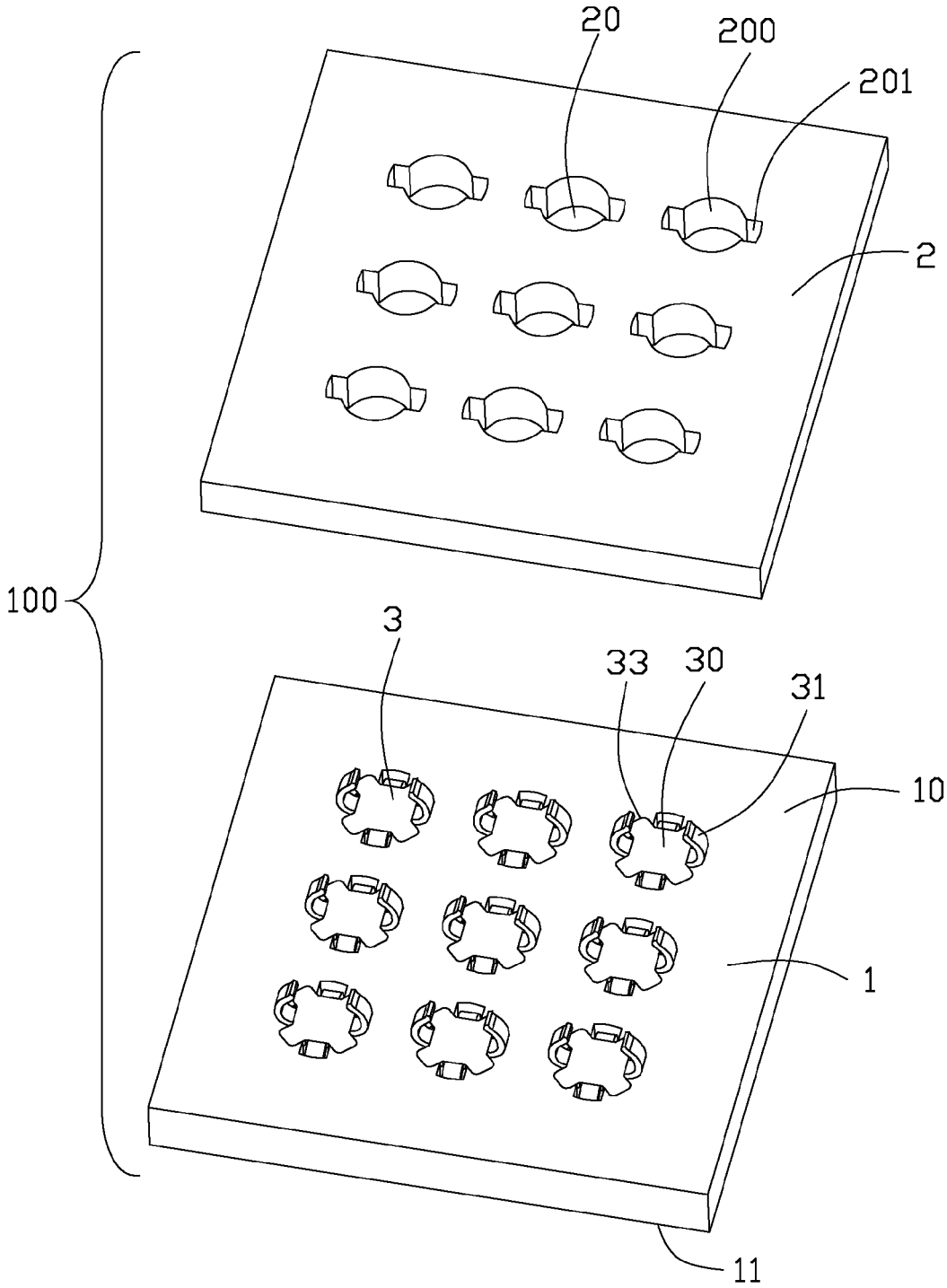
FIG. 2 is similar to FIG. 1, showing a second body detached from a first body.
Figure 3:
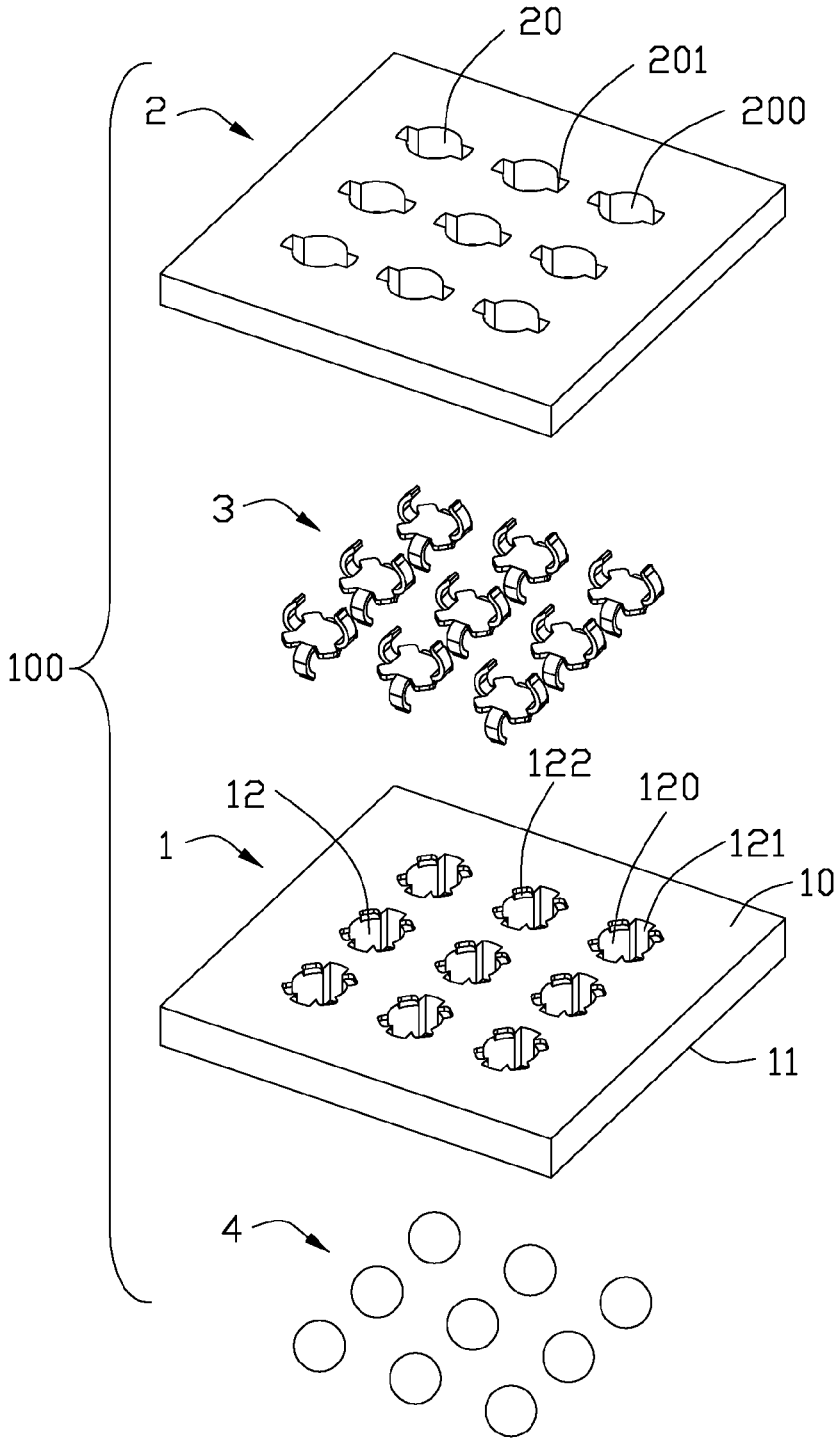
FIG. 3 is an exploded, perspective view of the electrical connector shown in FIG. 1.
Figure 4:
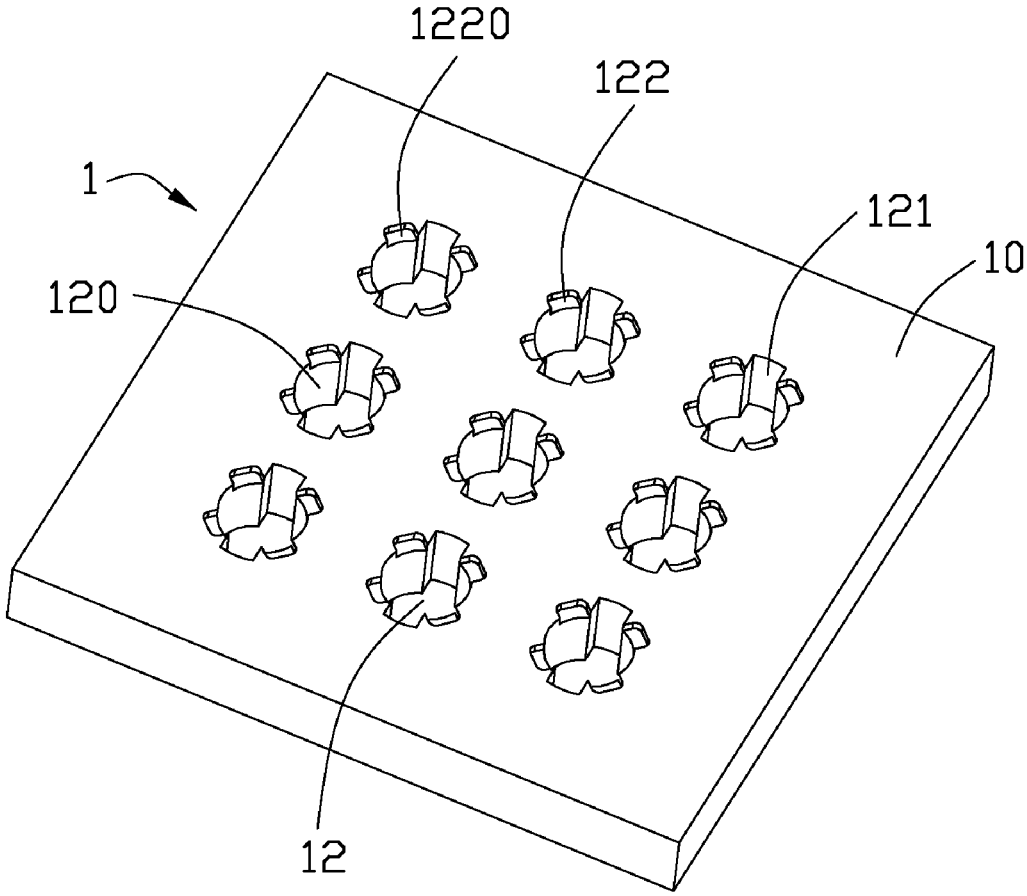
FIG. 4 is a perspective view of the first body of the electrical connector shown in FIG. 1.
Figure 5:
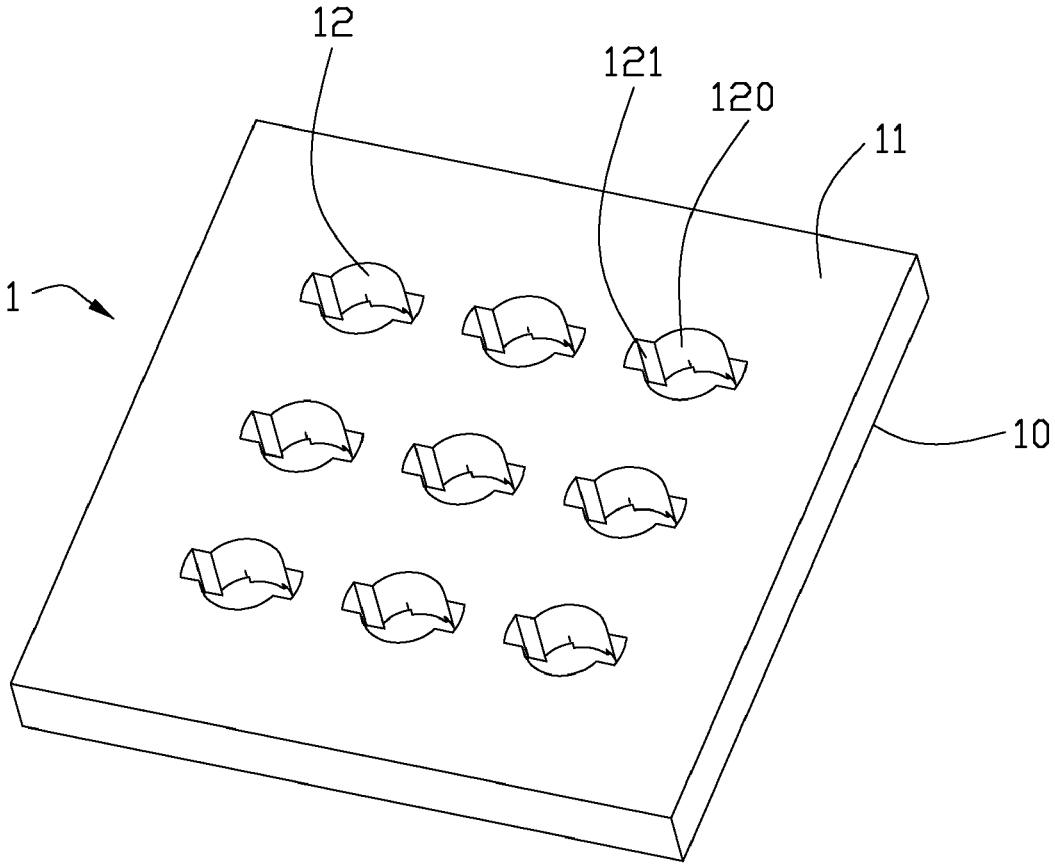
FIG. 5 is similar to FIG. 4, but taken from a different aspect.
Figure 6:
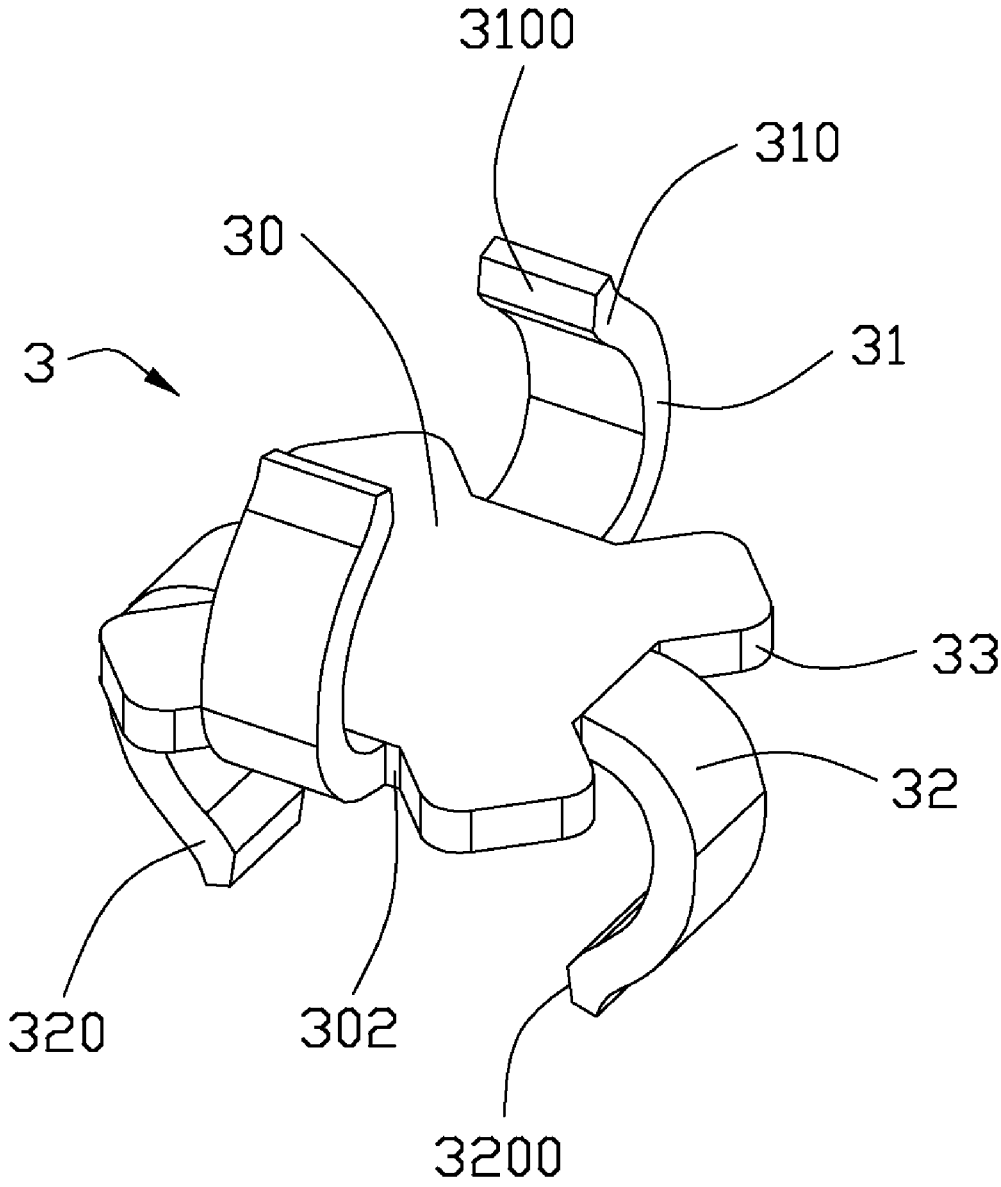
FIG. 6 is a perspective view of a terminal shown in FIG. 2.
Figure 7:
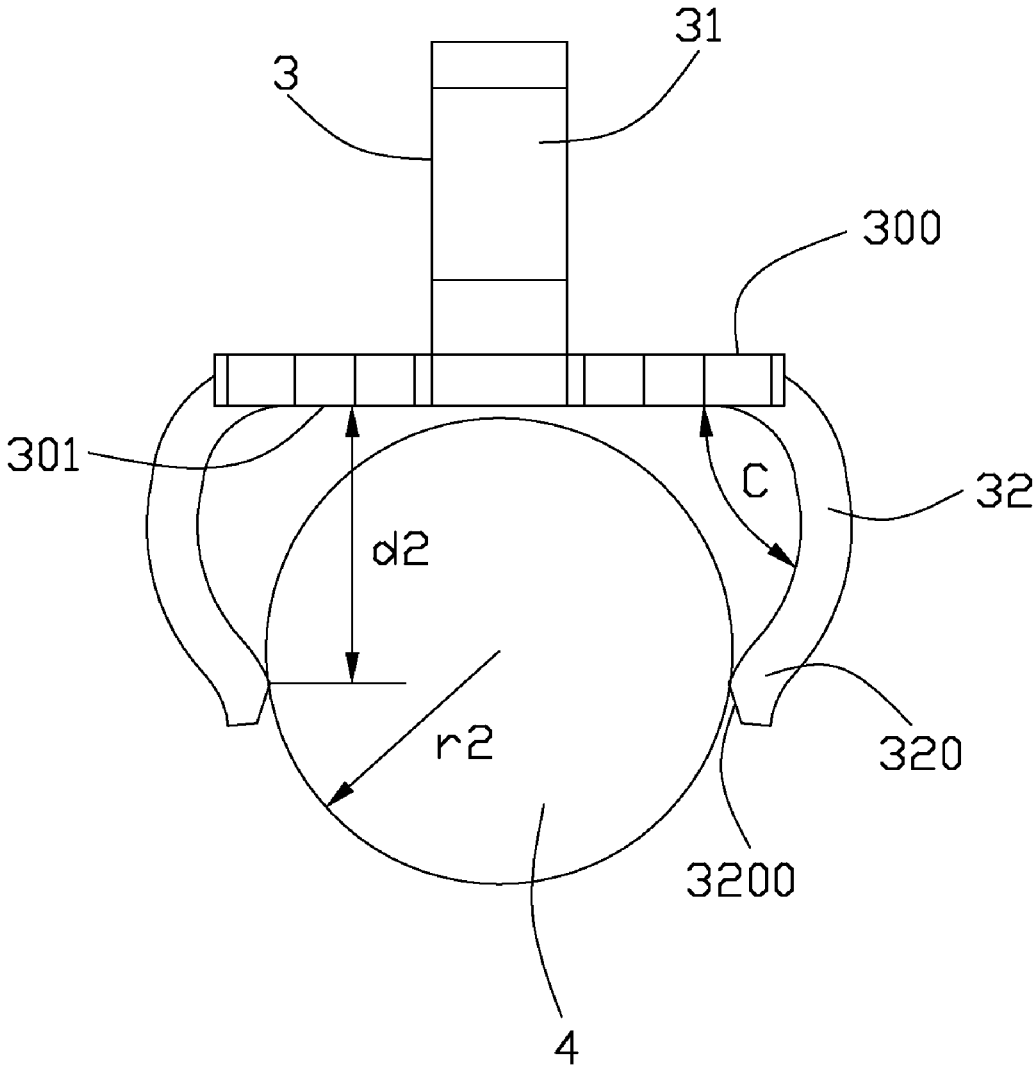
FIG. 7 is a front elevation view of the terminal, showing a fusible member is secured thereto.
Figure 8:
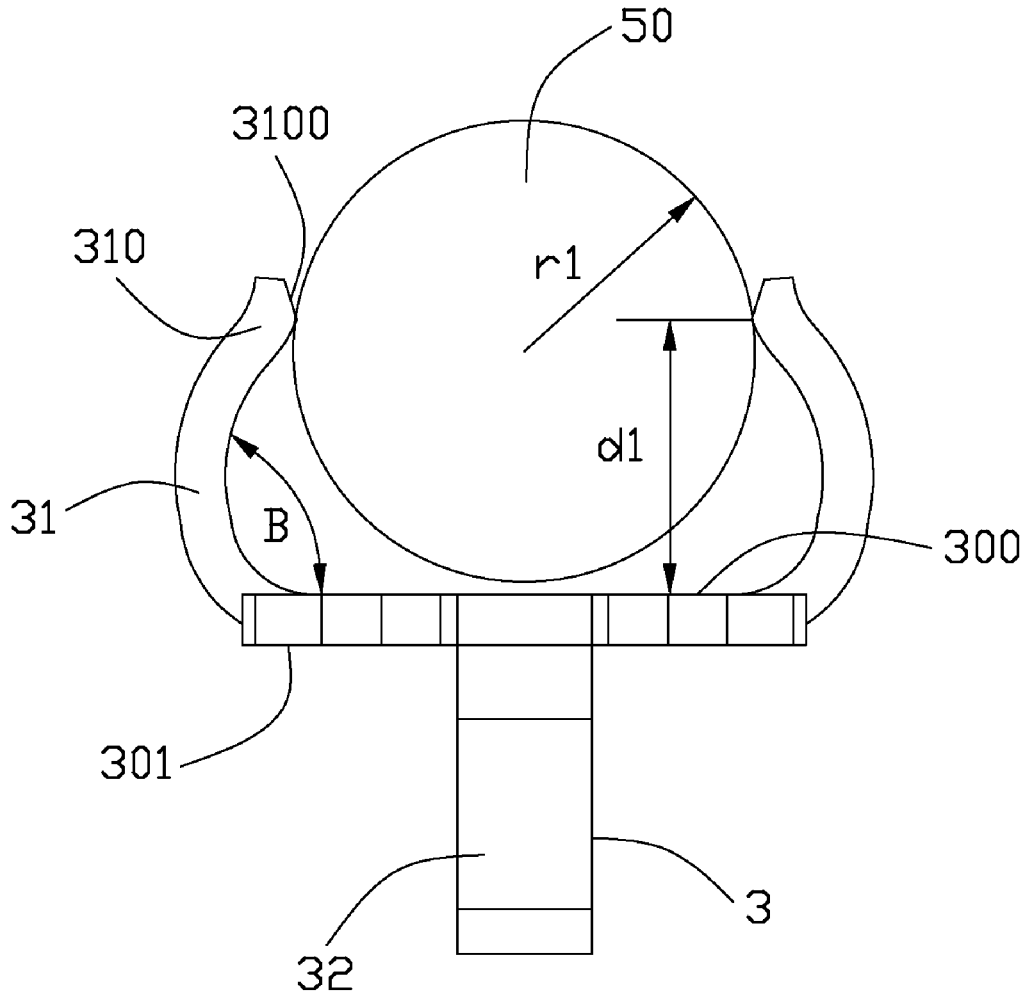
FIG. 8 is a side view of the terminal and the fusible member shown in FIG. 7.
Figure 9:
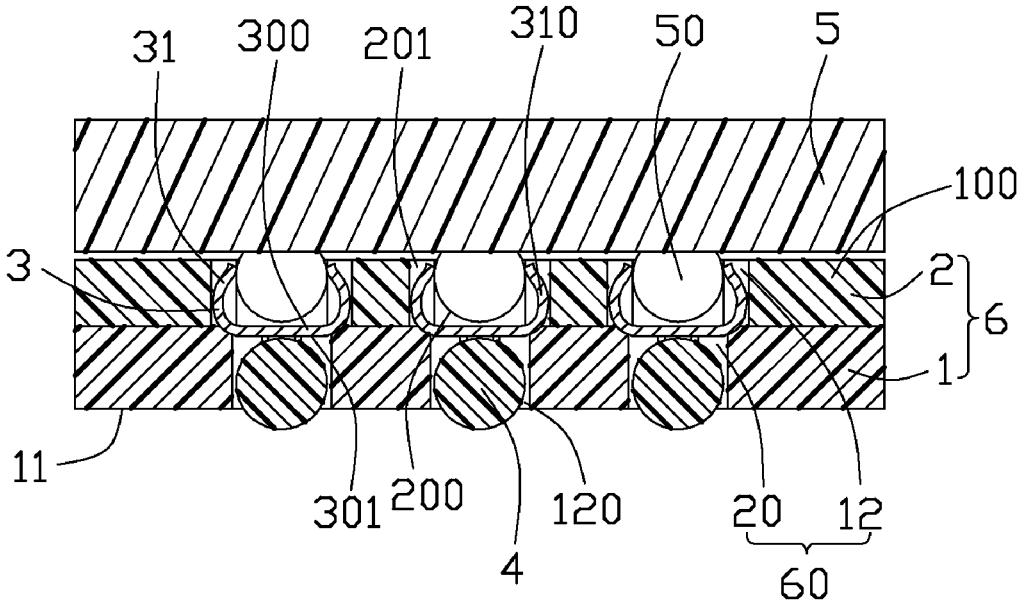
FIG. 9 is a cross sectional view of the electrical connector and the CPU.

Referring to FIGS. 1 to 3, the second body 2 defines a plurality of upper holes 20 extending therethrough and arranged in matrix. Each upper hole 20 includes a second center hole 200 used for receiving the solder ball 50 of the CPU 5 and a pair of second receiving holes 201 symmetrically located at opposite sides of the first center hole 200. The second center hole 200 has an elliptic configuration. A width along a short-axis direction of the second center hole 200 is similar with a diameter of the solder ball 50 of the CPU 5. The second receiving holes 201 each having a rectangle configuration are disposed at two sides of the second center hole 200 along a long-axis direction and communicating with the second center hole 200.

Referring to FIGS. 1 to 5, the first body 1 having a flat configuration has a top surface 10 and a bottom surface 11 opposite to the top surface 10. A plurality of bottom holes 12 extend from the top surface 10 to the bottom surface 11 of the first body 1 and has a configuration similar with the upper holes 20 of the second body 2. Each bottom hole 12 is perpendicular to the corresponding upper hole 20 and includes an elliptic-shape first center hole 120 for receiving the fusible member 4 and a pair of first receiving holes 121 located at opposite sides of the first center hole 120. A width along a short-axis direction of the first center hole 120 is similar with a diameter of the fusible member 4. The bottom hole 12 also has a plurality of retaining slots 122 symmetrically located therearound. The retaining slots 122 having an arc shape are sunken from the top surface 10 of the first body 1 and communicating with the first center hole 120. Each retaining slot 122 has a supporting surface 1220 for supporting the terminal 3.

Referring to FIGS. 2 to 3 and FIGS. 6 to 9, the terminals 3 stamped from a metal strip are received in the bottom holes 12 of the first body 1 and the upper holes 20 of the second body 2. Each terminal 3 includes a planer horizontal base portion 30, a pair of upper hands 31 bent from two opposite sides of the base portion 30, a pair of lower legs 32 bent from another two opposite sides of the base portion 30, and a plurality of holding portions 33 extending from corners of the base portion 30 in a horizontal direction. The base portion 30 has an upper surface 300, a lower surface 301 relative to the upper surface 300, and four sides 302 connecting the upper surface 300 and the lower surface 301.

The upper hands 31 bend upwardly from two opposite sides 302 of the base portion 30 and extend toward each other. The upper hands 31 are received in the second center hole 200 of the second body 2 and define a first receiving space 34 together with the second center hole 200 for receiving the solder ball 50. Each upper hand 31 has an upper clamping portion 310 at a free end thereof The upper clamping portions 310 can clamp the solder ball 50 of the CPU 5 to achieve electrical connection between the electrical connector 100 and the CPU 5. The upper clamping portion 310 has a first inclined surface 3100 for guiding the solder ball 50 into the first receiving space 34. A first angle B formed between the extensional direction of the upper clamping portion 310 and the upper surface 300 of the base portion 30 is less than 90 degree.

The lower legs 32 bend downwardly from another two opposite sides 302 of the base portion 30 and extend toward each other. The lower legs 32 are received in the first center hole 120 of the first body 1 and define a second receiving space (not shown) together with the first center hole 120 for receiving the fusible member 4. Each lower leg 32 has a bottom clamping portion 320 at a free end thereof. The bottom clamping portions 320 can clamp the fusible member 4 to preposition the fusible members 4 on the electrical connector 100, instead of predeterminately soldering fusible members 4 to the electrical connector 100, so as to reduce costs and make process simple. Therefore, the CPU 5 is easy to repair and replace when the CPU 5 is damaged. The bottom clamping portion 320 has a second inclined surface 3200 for guiding the fusible member 4 into the second receiving space (not shown). A second angle C formed between the extensional direction of the bottom clamping portion 320 and the lower surface 301 is less than 90 degree.

The holding portions 33 are received in the retaining slots 122 of the first body 1 and has a thickness similar with a vertical distance from the supporting surface 1220 of the retaining slot 122 to the top surface 10 of the first body 1. A projection of the upper hands 31 in a horizontal plane is perpendicular to a projection of the lower legs 32 in a horizontal plane. A first vertical distance d1 from an end of the upper clamping portion 310 to the upper surface 300 of the base portion 30 is not less than a radius r1 of the solder ball 50. A second vertical distance d2 from an end of the bottom clamping portion 320 to the lower surface 301 of the base portion 30 is not less than a radius r2 of the fusible member 4.

While the preferred embodiments in accordance with the present invention has been shown and described, equivalent modifications and changes known to persons skilled in the art according to the spirit of the present invention are considered within the scope of the present invention as defined in the appended claims.

What is claimed is:

1. An electrical connector for connecting a CPU (central processing unit) with a plurality of solder balls to a PCB (printed circuit board) comprising: an insulating housing having a plurality of passageways; and a plurality of terminals received in the corresponding passageways and each including a base portion having an upper surface and a lower surface opposite to each other, and a plurality of holding portions extending from the base portion; wherein each terminal has a plurality of upper hands bent upwardly from the base portion and a plurality of lower legs bent downwardly from the base portion, wherein the upper hands bent inwardly from the base portion, and wherein the lower legs bent inwardly from the base portion, wherein the electrical connector also includes a plurality of fusible members attached thereto and the lower legs of each terminal defines a second receiving space with the base portion for receiving the fusible member, and the upper hands of each terminal defines a first receiving space with the base portion for receiving the solder ball of the CPU, wherein each upper hand has an upper clamping portion at a free end thereof, and wherein the upper clamping portion has a first inclined surface for guiding the solder balls of the CPU to the first receiving space, wherein each lower leg has a bottom clamping portion at a free end thereof, and wherein the bottom clamping portion has a second inclined surface for guiding the fusible member into the second receiving space.

2. The electrical connector as claimed in claim 1, wherein the terminal has a first angle formed between an extensional direction of the upper clamping portion and the upper surface of the base portion, and wherein the first angle is less than 90 degree, and wherein the terminal has a second angle formed between an extensional direction of the bottom clamping portion and the lower surface of the base portion, and wherein the second angle is less than 90 degree.

3. The electrical connector as claimed in claim 1, wherein each terminal has a first vertical distance from an end of the upper clamping portion to the upper surface of the base portion and a second vertical distance from an end of the bottom clamping portion to the lower surface of the base portion, and wherein the first vertical distance is less than a radius of the solder ball of the CPU, and wherein the second vertical distance is less than a radius of the fusible member.

4. The electrical connector as claimed in claim 1, wherein the holding portions and the base portion are located in the same plane, and wherein the holding portions extend from the base portion along a horizontal direction.

5. The electrical connector as claimed in claim 1, wherein the insulating housing comprises a first body and a second body mounted on the first body, and wherein the first body has a plurality of bottom holes for receiving the upper hands of the terminals and the second body has a plurality of upper holes corresponding to the bottom holes for receiving the lower legs of the terminals.

6. The electrical connector as claimed in claim 5, wherein the first body has a top surface and a bottom surface opposite to the top surface, and wherein the bottom holes includes a plurality of retaining slots sunken from the top surface of the first body for respectively receiving the holding portions of each terminal.

7. A socket connector, comprising: an insulative housing configured by an lower substrate and an upper substrate, each of the lower and upper substrates defining a plurality of lower holes and upper holes aligned each other; and a plurality of contact terminals each having a retaining portion sandwiched between the upper and lower substrates, a plurality of upper hands extending into the upper holes, and a plurality of lower legs extending into corresponding lower holes, wherein the upper hands bent upwardly and inwardly from the retaining portion, and wherein the lower legs bent downwardly and inwardly from the retaining portion, wherein the socket connector also includes a plurality of fusible members attached thereto and the lower legs defines a second receiving space with the retaining portion for receiving the fusible member, and the upper hands of each terminal defines a first receiving space with the retaining potion, wherein each upper hand has an upper clamping portion at a free end thereof, and wherein the upper clamping portion has a first inclined surface, and wherein each lower leg has a bottom clamping portion at a free end thereof, and wherein the bottom clamping portion has a second inclined surface.

8. The socket connector as claimed in claim 7, wherein the retaining portions is configured of a horizontal plane.

9. An electrical connector assembly comprising: an insulative housing including stacked upper and lower bodies; a plurality of upper through holes defined in the upper body; a plurality of lower through holes defined in the lower body and essentially in vertically alignment with the corresponding upper through holes, respectively, each of the lower through holes cooperating with the aligned corresponding one upper through hole to define a contact receiving passageway; a plurality of contacts each disposed in the corresponding contact receiving passageway, each of said contacts defining a horizontal base essentially sandwiched between the upper body and the lower body, at least one upper leg extending upwardly from the base into the corresponding upper through hole for contacting an upper electronic component, and at least one lower leg extending downwardly from the base into the corresponding lower through hole for contacting a lower electronic component, wherein each contact includes at least one holding portion to be sandwiched between the upper body and the lower body for retaining the contact in position, and said holding portion extends laterally from the base portion, wherein said holding portion extends from a radial position which is different from those where the upper leg and the lower leg extend, wherein the upper leg is adapted to be engaged with an upper solder ball which is integrally formed with an electronic package while the lower leg is adapted to be engaged with a lower solder ball which is essentially associated with the lower leg which being ready to be soldered to a printed circuit board.

10. The electrical connector assembly as claimed in clam 9, wherein in each contact the upper leg and the lower leg extend from different radial positions with regard to the corresponding base.

* * * * *